US009862076B2

(12) United States Patent
Lai

(10) Patent No.: US 9,862,076 B2
(45) Date of Patent: Jan. 9, 2018

(54) PAWL CONTROL DEVICE FOR RATCHET WRENCH

(71) Applicant: Jim Lai, Changhua (TW)

(72) Inventor: Jim Lai, Changhua (TW)

( * ) Notice: Subject to any disclaimer, the term of this patent is extended or adjusted under 35 U.S.C. 154(b) by 23 days.

(21) Appl. No.: 15/086,027

(22) Filed: Mar. 30, 2016

(65) Prior Publication Data

US 2017/0282336 A1 Oct. 5, 2017

(51) Int. Cl.
*B25B 13/46* (2006.01)

(52) U.S. Cl.
CPC ..... *B25B 13/463* (2013.01); *B25B 13/462* (2013.01); *B25B 13/461* (2013.01)

(58) Field of Classification Search
CPC ... B25B 13/463; B25B 13/462; B25B 13/461; B25B 15/04; B25B 13/465
USPC ..... 81/60–63.2
See application file for complete search history.

(56) References Cited

U.S. PATENT DOCUMENTS 5,636,557 A * 6/1997 Ma ..... B25B 13/463 81/60
6,446,530 B1 * 9/2002 Chang ..... B25B 13/08 81/58
6,647,832 B2 * 11/2003 Hu ..... B25B 13/463 192/43.1
6,748,825 B2 * 6/2004 Hsu ..... B25B 13/463 192/41 R
7,878,095 B2 * 2/2011 Wu ..... B25B 13/08 81/179
8,104,381 B1 * 1/2012 Chen ..... B25B 13/463 81/63.2
8,272,297 B1 * 9/2012 Chen ..... B25B 13/463 81/60
9,016,174 B2 * 4/2015 Lee ..... B25B 13/463 81/60
2003/0051583 A1 * 3/2003 Lin ..... B25B 13/463 81/60
2003/0213342 A1 * 11/2003 Wu ..... B25B 13/463 81/60
2006/0027049 A1 * 2/2006 Arnold ..... B25B 13/463 81/60
2007/0289414 A1 * 12/2007 Lee ..... B25B 13/463 81/60
2013/0291688 A1 * 11/2013 Hu ..... B25B 13/463 81/63.1

* cited by examiner

*Primary Examiner* — Larry E Waggle, Jr.
*Assistant Examiner* — Danny Hong

(57) ABSTRACT

A ratchet wrench includes a handle and a head through which a hole is defined. A recess is defined in the inner periphery of the hole. A driving member is rotatably received in the hole. A pawl and a positioning member are respectively located in two respective ends of the recess. A spring is connected between the pawl and the positioning member. The pawl has a slot defined in a lateral side thereof so as to be connected to one end of the spring. The positioning member is a resilient member and has an engaging portion and a curved portion. An opening is defined between the engaging portion and the curved portion. The other end of the spring is engaged with the opening. The spring linearly biased between the pawl and the positioning member to engage the pawl with the driving member.

4 Claims, 6 Drawing Sheets

PAWL CONTROL DEVICE FOR RATCHET WRENCH

BACKGROUND OF THE INVENTION

1. Fields of the Invention

The present invention relates to a ratchet wrench, and more particularly, to a pawl control device for a ratchet wrench. The spring pushes the pawl linearly to precisely engage the pawl with the driving member.

2. Descriptions of Related Art

The conventional ratchet wrench generally includes a driving member rotatably receiving in the head of the ratchet wrench, and a pawl is engaged with the driving member so as to control the rotation that the driving member drives an object. The efficiency of the ratchet wrench relies on the precision engagement between the pawl and the driving member. The teeth defined in the outside of the driving member are easily worn out, and once the teeth in of the driving member are worn out, the torque cannot be transferred to the object as expected. Therefore, how to reduce the wearing of the teeth of the driving member is one of the concerns of a good ratchet wrench.

One of the conventional ratchet wrenches discloses a control device for a ratchet wrench wherein a curved recess is defined in the inner periphery of the hole of the head and a pawl is movably received in the curved recess. The pawl has teeth in the front side so as to be engaged with the teeth of the driving member, and a curved face is formed at the rear side of the pawl. The pawl is biased by a spring which pushes the pawl to one end of the curved recess such that the recessed face of the pawl contacts against the inner wall of the curved recess to bear a larger torque. However, when the pawl is pushed either one of two ends of the curved recess, the spring is deformed and becomes a curved status. The deformation of the spring makes the pawl not able to be precisely engaged with the driving member. Therefore, the teeth of the driving member will be worn quickly. In addition, because the spring is not operated linearly, the spring can only apply a component force to push the pawl to be engaged with the driving member, the component force may not sufficiently maintain a secure engagement between the pawl and the driving member.

The present invention intends to provide a control device of a ratchet wrench to eliminate the shortcomings mentioned above.

SUMMARY OF THE INVENTION

The present invention relates to a ratchet wrench and comprises a handle and a head, wherein the head has a hole defined therethrough, and a recess is defined in the inner periphery of the hole and located between the hole and the handle. A driving member is rotatably received in the hole and has first teeth defined in the outside thereof. A pawl and a positioning member are respectively located in two respective ends of the recess. A spring is connected between the pawl and the positioning member. The pawl has second teeth defined in the front side thereof, the second teeth face the first teeth. A slot is defined in the lateral side of the pawl so that the first end of the spring is engaged with the slot. The positioning member has an engaging portion and a curved portion. An opening is defined between the engaging portion and the curved portion. The second end of the spring is engaged with the opening. The spring is linearly biased between the pawl and the positioning member. The pawl is pushed by the linearly operational spring to move along the recess. The second teeth of the pawl are engaged with the first teeth of the driving member.

Preferably, the recess has a curved inner periphery, and the pawl has a curved face which is connected between the front side having the first teeth and the lateral side having the slot of the pawl. The curved face of the pawl moves along the curved inner periphery of the recess.

Preferably, the slot is a dove-tailed slot with which the first end of the spring is engaged.

Preferably, the positioning member is a stainless steel plate which is bent to include the engaging portion and the curved portion. The positioning member is a resilient member. The engaging portion has a bent end which is connected to the second end of the spring.

Preferably, the curved portion has a protrusion extending from the inside thereof, and the protrusion is inserted into the second end of the spring.

The primary object of the present invention is to provide a ratchet wrench which includes a pawl and a positioning member located in two ends of the recess in the head. A spring is linearly biased between the pawl and the positioning member so that the spring is linearly operated during operating the ratchet wrench.

Another object of the present invention is to provide a ratchet wrench which includes a positioning member made of a bent stainless plate which provides proper resilient feature so as to deform to absorb the impact during the first teeth of the driving member moving over the surface of the engaging portion. The flexibility of the engaging portion also reduces wearing to the first teeth of the driving member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
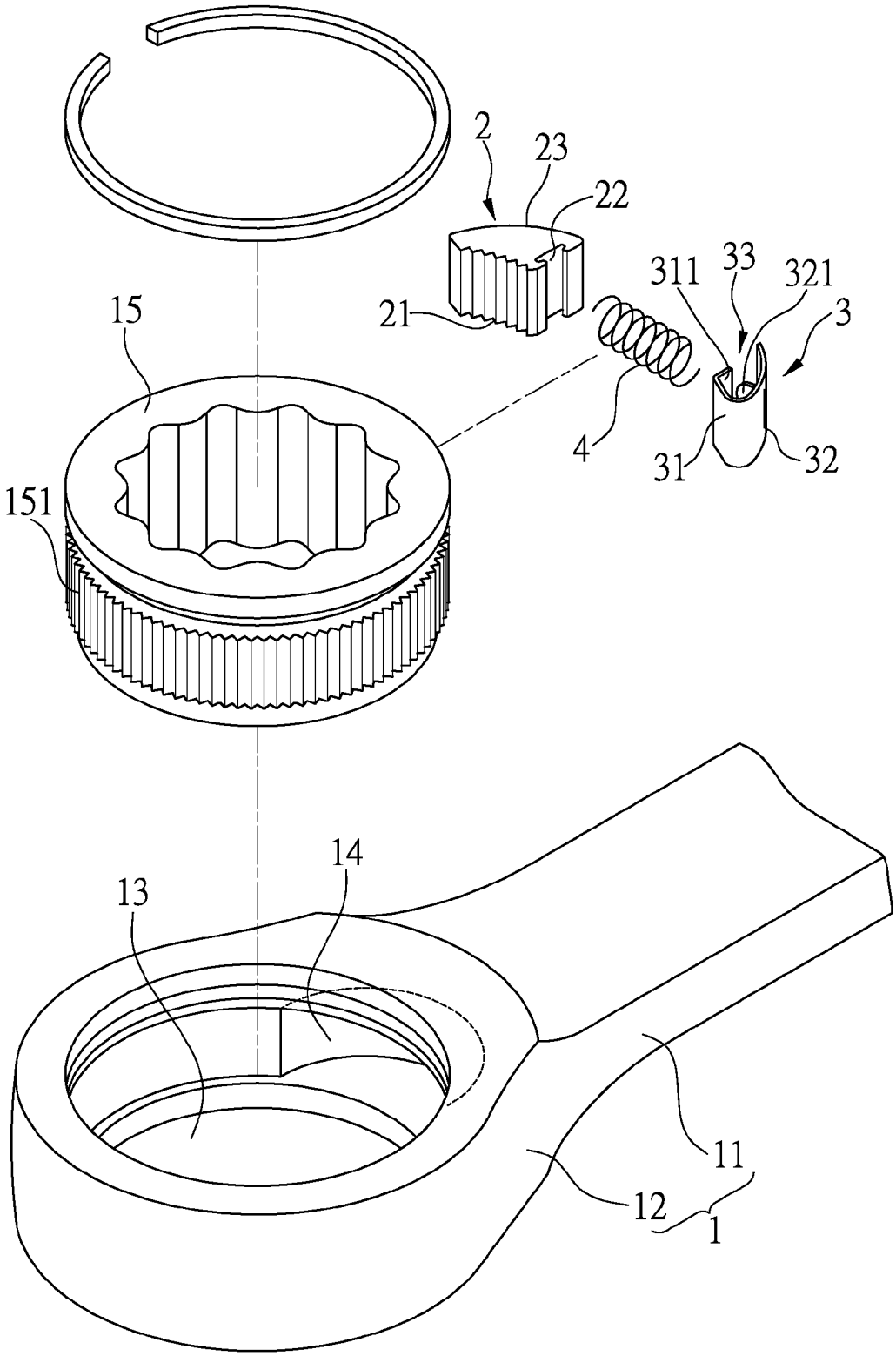
FIG. 1 is an exploded view of the ratchet wrench of the present invention.
Figure 2:
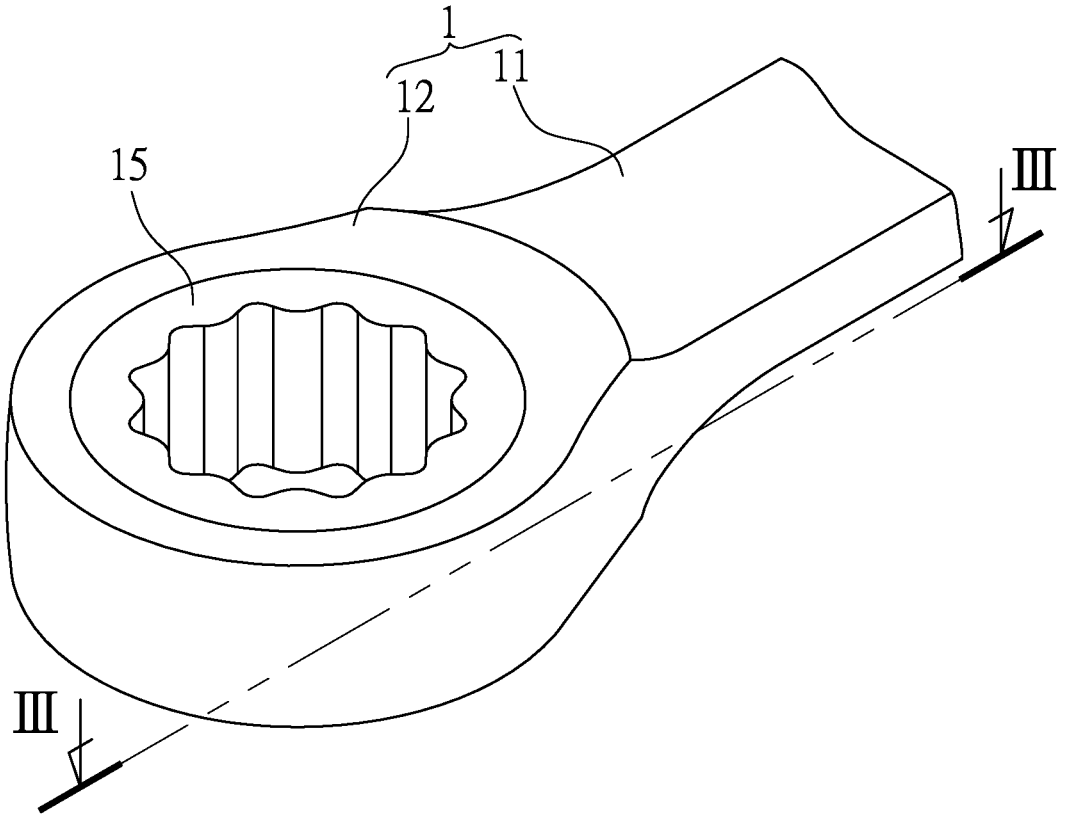
FIG. 2 is a perspective view to show the ratchet wrench of the present invention.
Figure 3:
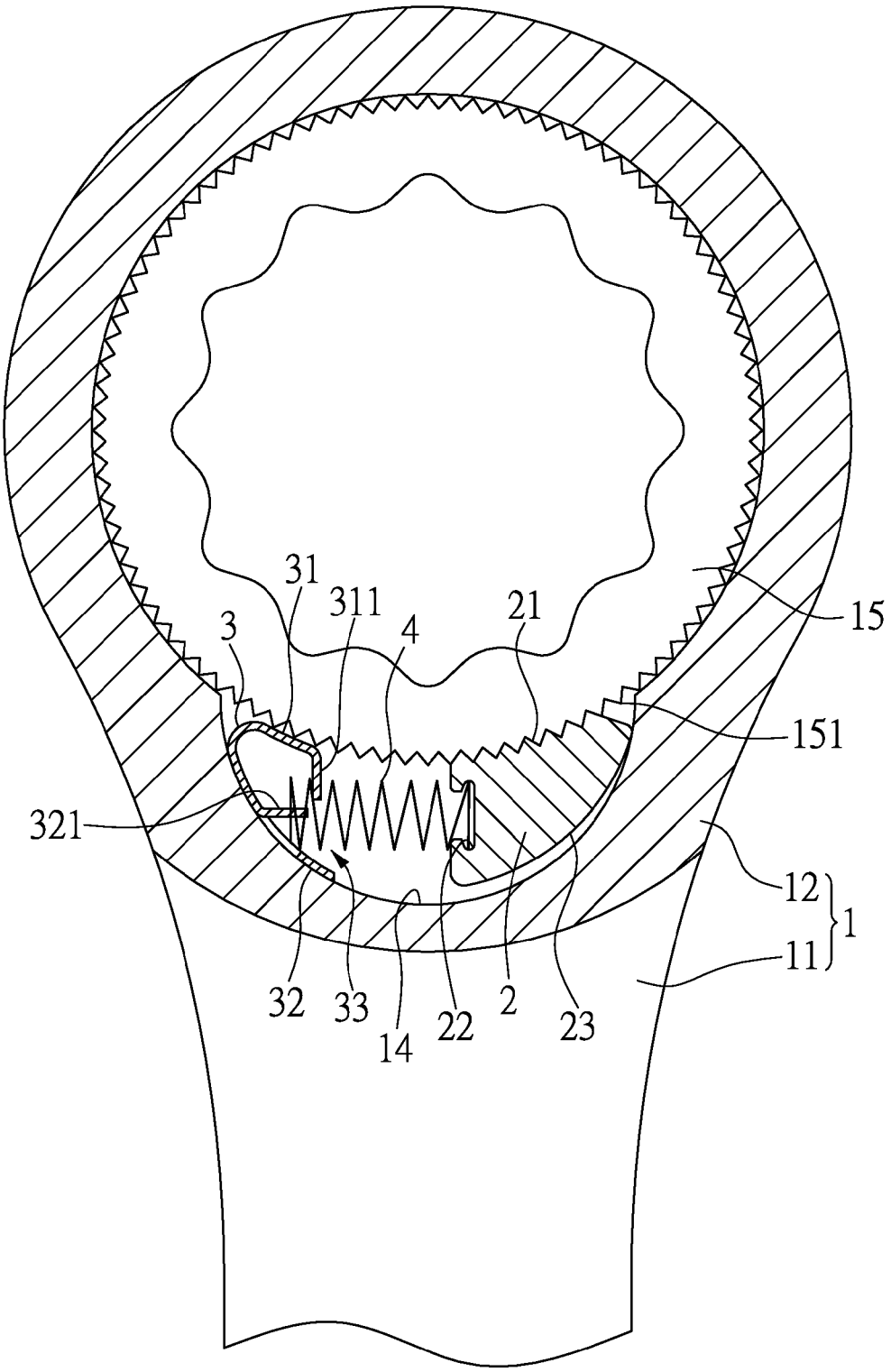
FIG. 3 is a cross sectional view, taken along line III-III in FIG. 2.

Referring to FIGS. 1 to 3, the ratchet wrench 1 of the present invention comprises a handle 11 and a head 12, wherein the head 12 has a hole 13 defined therethrough. A recess 14 is defined in the inner periphery of the hole 13 and located between the hole 13 and the handle 11. The recess 14 has a curved inner periphery.

A driving member 15 is rotatably received in the hole 13 and has first teeth 151 defined in the outside thereof. The driving member 15 has a mounting hole defined centrally therethrough so as to be mounted to an object.

Figure 4:
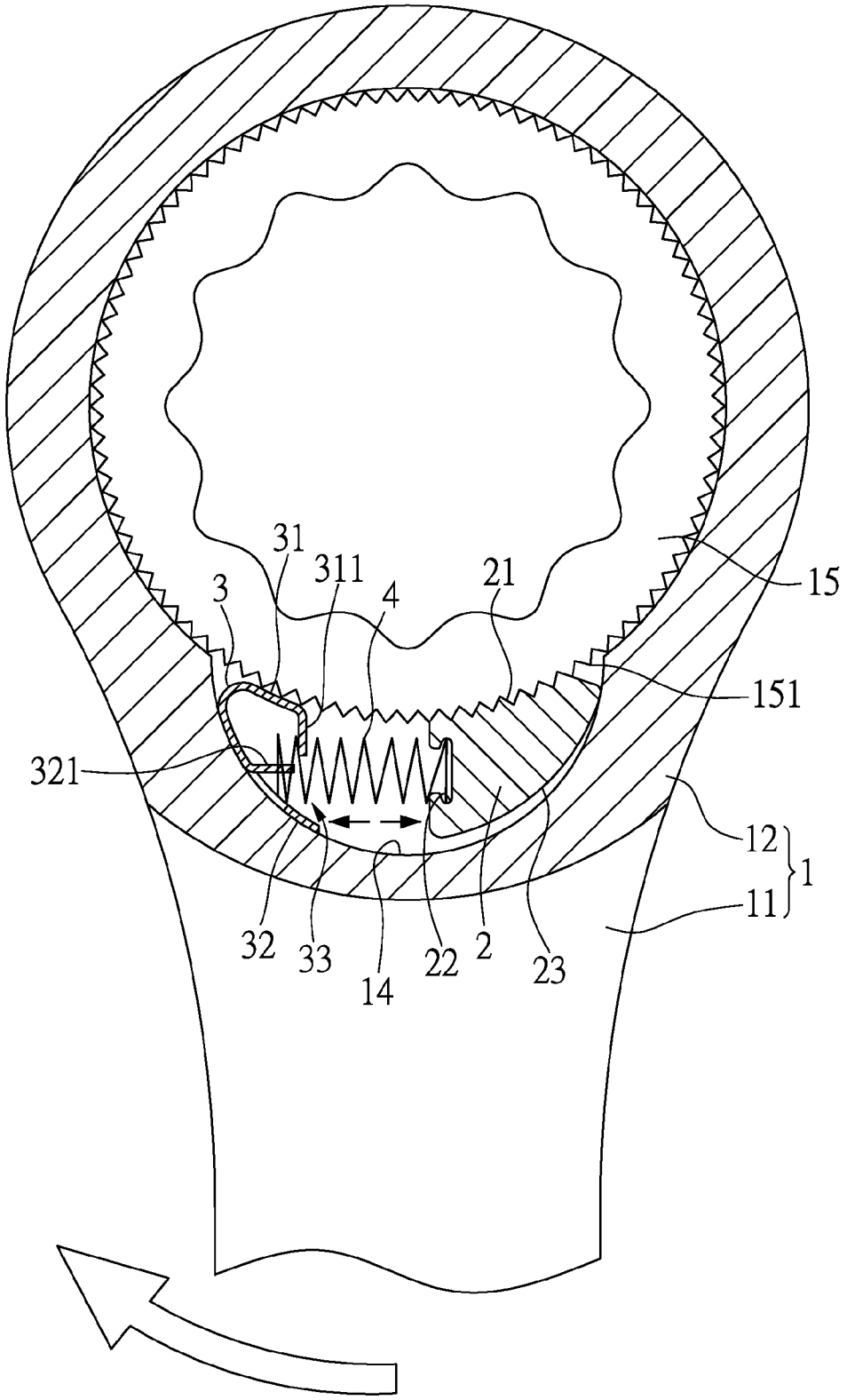
FIG. 4 shows that the ratchet wrench of the present invention is rotated clockwise.

A pawl 2 and a positioning member 3 are respectively located in two respective ends of the recess 14, and a spring 4 is connected between the pawl 2 and the positioning member 3. The pawl 2 is a substantially wedge-shaped member and includes a front side, a lateral side and a rear side which is connected between the front side and the lateral side. Multiple second teeth 21 are defined in the front side thereof, and the second teeth 21 face the first teeth 151. A slot 22 is defined in the lateral side of the pawl 2 and the slot 22 is a dove-tailed slot. The first end of the spring 4 is engaged with the slot 22 and cannot be disengaged from the slot 22 in the direction perpendicular to the lateral side of the pawl 2. The positioning member 3 is a stainless steel plate which is bent to include an engaging portion 31 and a curved portion 32 which extends integrally from the engaging portion 31. An opening 33 is defined between the engaging portion 31 and the curved portion 32. The positioning member 3 is a resilient member. The second end of the spring 4 is engaged with the opening 33. Specifically, the engaging portion 31 has a bent end 311 which is connected to the second end of the spring 4. The curved portion 32 has a protrusion 321 extending from the inside thereof, and the protrusion 321 is inserted into the second end of the spring 4. The slot 22 of the pawl 2 and the opening 33 of the positioning member 3 are located along a straight line. In other words, the spring 4 is linearly biased between the pawl 2 and the positioning member 3. The pawl 2 has a curved face 23 which is connected between the front side having the first teeth 21 and the lateral side having the slot 22 of the pawl 2. The curved face 23 of the pawl 2 moves along the curved inner periphery of the recess 14. The pawl 3 is pushed by the linearly operational spring 4 to move along the recess 14 so that the second teeth 21 of the pawl 2 are engaged with the first teeth 151 of the driving member 15 when the ratchet wrench 1 is rotated clockwise as shown in FIG. 4.

Figure 5:
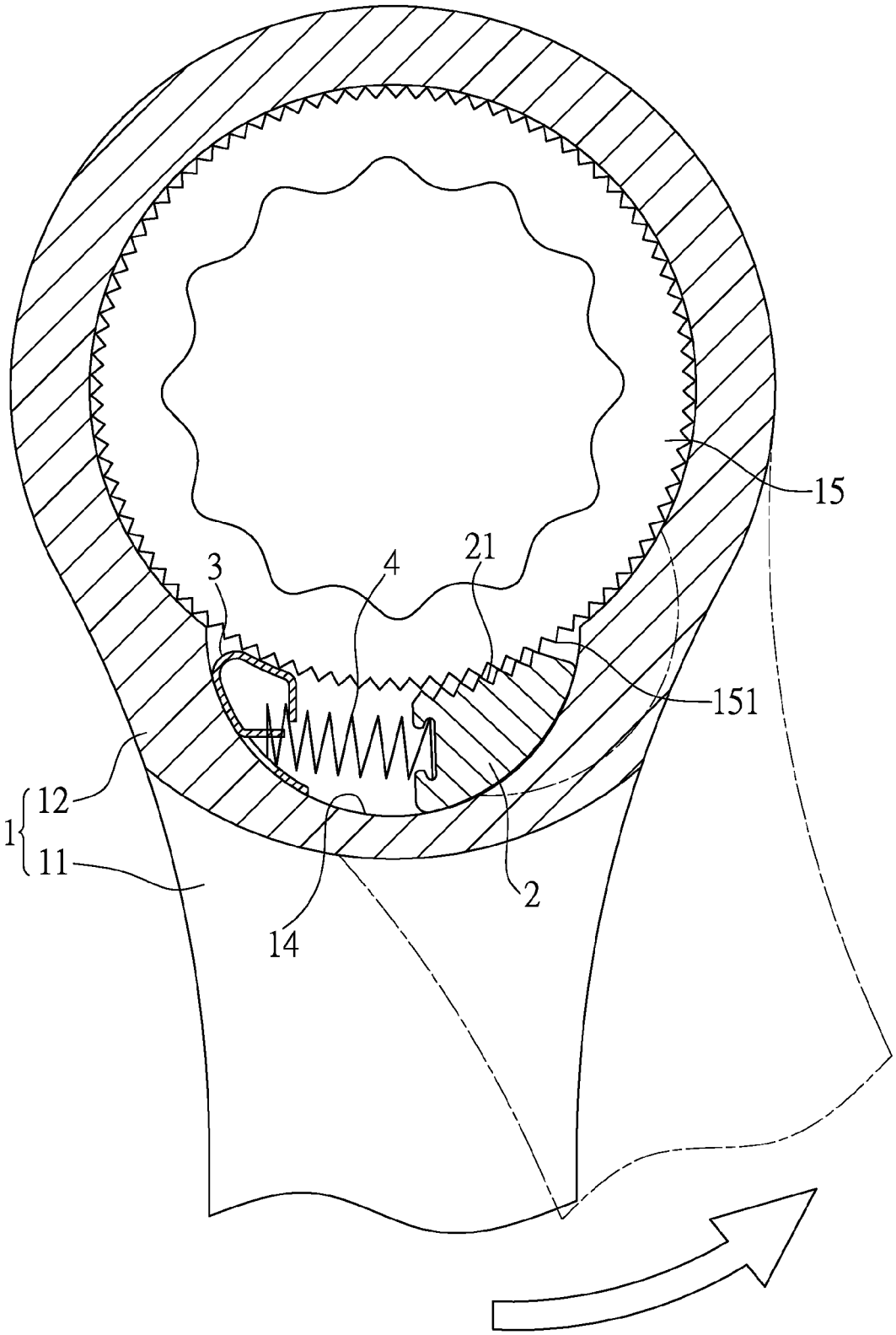
FIG. 5 shows that the ratchet wrench of the present invention is rotated counter clockwise.

As shown in FIG. 5, when the ratchet wrench 1 is rotated counter clockwise, the inner periphery of the recess 14 tends to remove away from the pawl 2 so that the second teeth 21 of the pawl 2 are disengaged from the first teeth 151 of the driving member 15. Under this status, the ratchet wrench 1 is freely rotated relative to the object. The pawl 2 and the positioning member 3 do not have any restriction means to restrict their position except for the inner periphery of the recess 14, so that the spring 4 is linearly operated to move the pawl 2 along the inner periphery of the recess 14.

Figure 6:
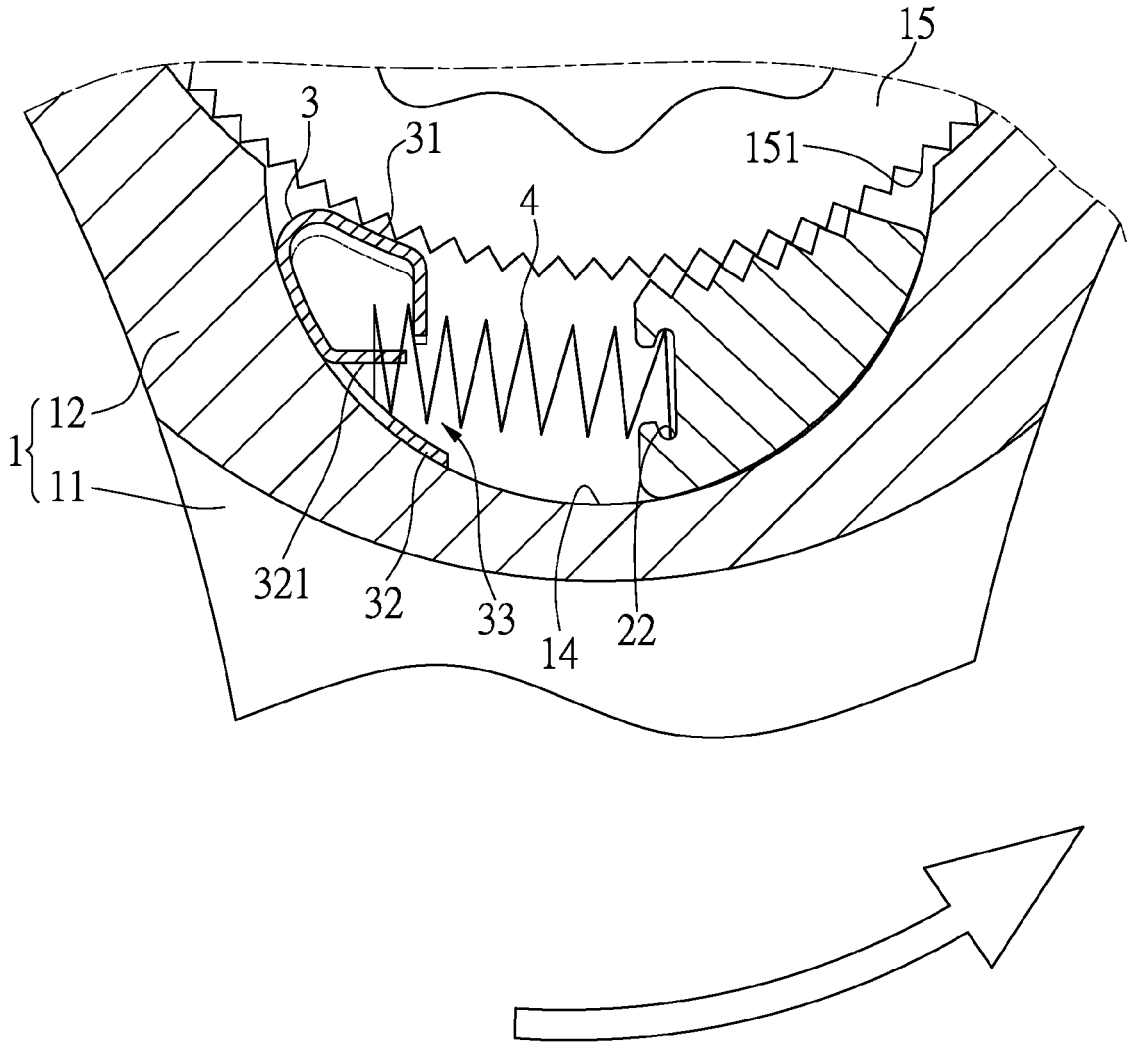
FIG. 6 is an enlarged view to show the relationship between the pawl and the driving member when the ratchet wrench of the present invention is rotated counter clockwise.

As shown in FIG. 6, when the ratchet wrench 1 is rotated counter clockwise, the positioning member 3 is moved by the inner periphery of the recess 14, the engaging portion 31 of the positioning member 3 is slightly deformed as shown by the phantom line, and the first teeth 151 of the driving member 15 move along the surface of the engaging portion 31, this also reduces wearing to the first teeth 151.

The advantages of the present invention are that the pawl 2 and the positioning member 3 do not have any restriction means to restrict their position except for the inner periphery of the recess 14, so that the spring 4 is linearly operated to move the pawl 2 along the inner periphery of the recess 14 to precisely engage with the driving member 15.

The positioning member 3 is a stainless steel plate which is bent to include the engaging portion 31 and the curved portion 32, so that the positioning member 3 has a certain level of flexibility which allows the engaging portion 31 of the positioning member 3 to be slightly deformed so that when the first teeth 151 of the driving member 15 move along the surface of the engaging portion 31, the wearing to the first teeth 151 is reduced.

While we have shown and described the embodiment in accordance with the present invention, it should be clear to those skilled in the art that further embodiments may be made without departing from the scope of the present invention.

What is claimed is:

1. A ratchet wrench comprising:

a handle and a head, the head having a hole defined there through, a recess defined in an inner periphery of the hole and located between the hole and the handle;

a driving member rotatably received in the hole and having first teeth defined in an outside thereof; and a pawl and a positioning member respectively located in two respective ends of the recess, a spring connected between the pawl and the positioning member, the pawl having second teeth defined in a front side thereof, the second teeth facing the first teeth, a slot with a tapered opening defined in a lateral side of the pawl, a first end of the spring inserted into the slot and abutting the tapered opening so that the first end of the spring cannot be disengaged from the slot in a direction perpendicular to the lateral side of the pawl, the positioning member having an engaging portion and a curved portion, the engaging portion resiliently in contact with being resiliently biased towards the first teeth of the driving member and resiliently urged away from the first teeth by the spring, an opening defined between the engaging portion and the curved portion, the engaging portion having a bent end, a second end of the spring inserted into the opening and engaging the bent end so that the second end cannot be disengaged from the opening along the direction perpendicular to the lateral side of the pawl, the curved portion having a protrusion extending from an inside thereof, the protrusion inserted into the second end of the spring, the spring linearly biased between the pawl and the positioning member, the pawl being pushed by the linearly operational spring to move along the recess, the second teeth of the pawl engaging the first teeth of the driving member.

2. The ratchet wrench as claimed in claim 1, wherein the recess has a curved inner periphery, the pawl has a curved face which is connected between the front side having the first teeth and the lateral side having the slot of the pawl, the curved face of the pawl moves along the curved inner periphery of the recess.

3. The ratchet wrench as claimed in claim 1, wherein the slot is a dove-tailed slot with which the first end of the spring is engaged.

4. The ratchet wrench as claimed in claim 2, wherein the slot is a dove-tailed slot with which the first end of the spring is engaged.

* * * * *